US007302821B1

(12) United States Patent
Dariavach et al.

(10) Patent No.: US 7,302,821 B1
(45) Date of Patent: Dec. 4, 2007

(54) TECHNIQUES FOR MANUFACTURING A PRODUCT USING ELECTRIC CURRENT DURING PLASTIC DEFORMATION OF MATERIAL

(75) Inventors: Nader G. Dariavach, Upton, MA (US); James A. Rice, Waukesha, WI (US)

(73) Assignee: EMC Corporation, Hopkinton, MA (US)

( * ) Notice: Subject to any disclaimer, the term of this patent is extended or adjusted under 35 U.S.C. 154(b) by 181 days.

(21) Appl. No.: 11/023,103

(22) Filed: Dec. 27, 2004

(51) Int. Cl.
*B21D 37/16* (2006.01)

(52) U.S. Cl. ..... 72/342.96; 72/364; 72/200; 219/152; 219/162

(58) Field of Classification Search ..... 72/342.1, 72/342.5, 342.96, 342.7, 342.8, 342.92, 200, 72/56; 219/152, 50, 156, 158, 161, 162
See application file for complete search history.

(56) References Cited

U.S. PATENT DOCUMENTS

| | | | | |
|---|---|---|---|---|
| 531,197 | A | 12/1894 | Lemp | |
| 2,473,245 | A * | 6/1949 | Hanna | 219/152 |
| 2,890,324 | A * | 6/1959 | Havlik | 219/149 |
| 2,973,043 | A * | 2/1961 | Stich | 219/156 |
| 3,988,913 | A * | 11/1976 | Metcalfe et al. | 72/69 |
| 3,988,914 | A * | 11/1976 | Metcalfe et al. | 72/69 |
| 4,307,280 | A | 12/1981 | Ecer | |
| 4,532,793 | A * | 8/1985 | Bezold | 72/342.96 |
| 5,042,281 | A * | 8/1991 | Metcalfe | 72/200 |
| 5,410,132 | A * | 4/1995 | Gregg et al. | 219/604 |
| 5,515,705 | A * | 5/1996 | Weldon et al. | 72/19.1 |
| 6,383,446 | B1 * | 5/2002 | Tokita | 419/38 |
| 6,463,779 | B1 * | 10/2002 | Terziakin | 72/342.96 |
| 6,489,584 | B1 | 12/2002 | Kelly | |
| 7,028,522 | B2 * | 4/2006 | Kim et al. | 72/202 |
| 2006/0060268 | A1 * | 3/2006 | Machrowicz et al. | 148/575 |
| 2006/0060570 | A1 * | 3/2006 | Machrowicz | 219/50 |

FOREIGN PATENT DOCUMENTS

RO 91642 A * 5/1987

OTHER PUBLICATIONS

Nader G. Dariavach, "The Effect of High Density Electric Pulses on Sintered Aluminum 201AB SiC MMC PM Compacts During Plastic Deformation", Oct. 2002, pp. 1-176.
Nader G. Dariavach and James A. Rice, "Electromigration and the Electroplastic Effect in Aluminum SiC MMCs", May 2000, pp. 40-42.
U.S. Appl. No. 11/022,999, filed Dec. 27, 2004, Dariavach, et al.
U.S. Appl. No. 11/022,512, filed Dec. 22, 2004, Dariavach, et al.

* cited by examiner

*Primary Examiner*—Dmitry Suhol
(74) *Attorney, Agent, or Firm*—BainwoodHuang

(57) ABSTRACT

A technique for manufacturing a product involves receiving material, providing plastic deformation to the material to at least partially form the product, and applying electric current to the material while providing the plastic deformation to the material. The electric current is configured to reduce flow stresses within the material during plastic deformation. In some arrangements, the electric current is a series of high-density, short electric pulses which increases plasticity due to increasing the dislocation mobility of the deformed material. In some arrangements, the electric current provides an electric current density through the material of at least 1000 Amperes per square millimeter with each electric pulse lasting no longer than 0.01 seconds.

17 Claims, 6 Drawing Sheets

TECHNIQUES FOR MANUFACTURING A PRODUCT USING ELECTRIC CURRENT DURING PLASTIC DEFORMATION OF MATERIAL

BACKGROUND

There are a variety of conventional approaches to plastically deforming metal when manufacturing metal products. Such approaches include forging, rolling, extrusion, drawing and other variations of these processes.

During plastic deformation, changes in both the metal and the equipment may occur. In particular, deforming metal in particular ways may cause the metal to become undesirably harder and less ductile (i.e., brittle). Additionally, the equipment which handles the metal wears out after certain amounts of use due to wear and tear. For example, reinforcements which typically exist in metal matrix composite (MMC) material are very abrasive and are capable of wearing out stamping equipment at more than 10 times the rate vis-à-vis non-MMC material.

When certain manufacturers make metal components, the manufacturers choose to apply heat to the metal to increase ductility. These manufacturers pass the metal material through high temperature environments (e.g., ovens) to soften the metal material during deformation. Such heat facilitates workability of the metal and may be easier on the equipment. At the same time, heat application significantly reduces dimensional accuracy and surface finish.

SUMMARY

Improved techniques for manufacturing a product involve the use of electric current while plastically deforming product material (e.g., metal) during formation of the product. In particular, electric current in the form of a series of high-density, short electric pulses passes through the material resulting in a reduction of flow stresses within the material during plastic deformation (e.g., pressing, bending, rolling, drawing, extruding, combinations thereof, etc.). This flow stress reduction improves ductility during plastic deformation, and decreases wear and tear on equipment.

One embodiment is directed to a method of manufacturing a product. The method includes receiving material, providing plastic deformation to the material to at least partially form the product (e.g., bending, rolling, etc.), and applying electric current to the material while providing the plastic deformation to the material. The electric current is configured to reduce flow stresses within the material during plastic deformation. In some arrangements, the electric current is a series of high-density, short electric pulses which increases plasticity due to increasing the dislocation mobility of the deformed material. In some arrangements, the electric current provides an electric current density through the material of at least 1000 Amperes per square millimeter with each electric pulse lasting no longer than 0.01 seconds.

BRIEF DESCRIPTION OF THE DRAWINGS

The foregoing and other objects, features and advantages of the invention will be apparent from the following description of particular embodiments of the invention, as illustrated in the accompanying drawings in which like reference characters refer to the same parts throughout the different views. The drawings are not necessarily to scale, emphasis instead being placed upon illustrating the principles of the invention.

DETAILED DESCRIPTION

Improved techniques for manufacturing products involve the use of electric current while plastically deforming material (e.g., metal) during formation of the products. In particular, electric current in the form of a series of high-density, short electric pulses passes through the material resulting in a reduction of flow stresses within the material during plastic deformation (e.g., pressing, bending, rolling, drawing, extruding, combinations thereof, etc.). Such a reduction of flow stresses enhances material ductility during plastic deformation, and decreases wear and tear on the manufacturing equipment.

Figure 1:
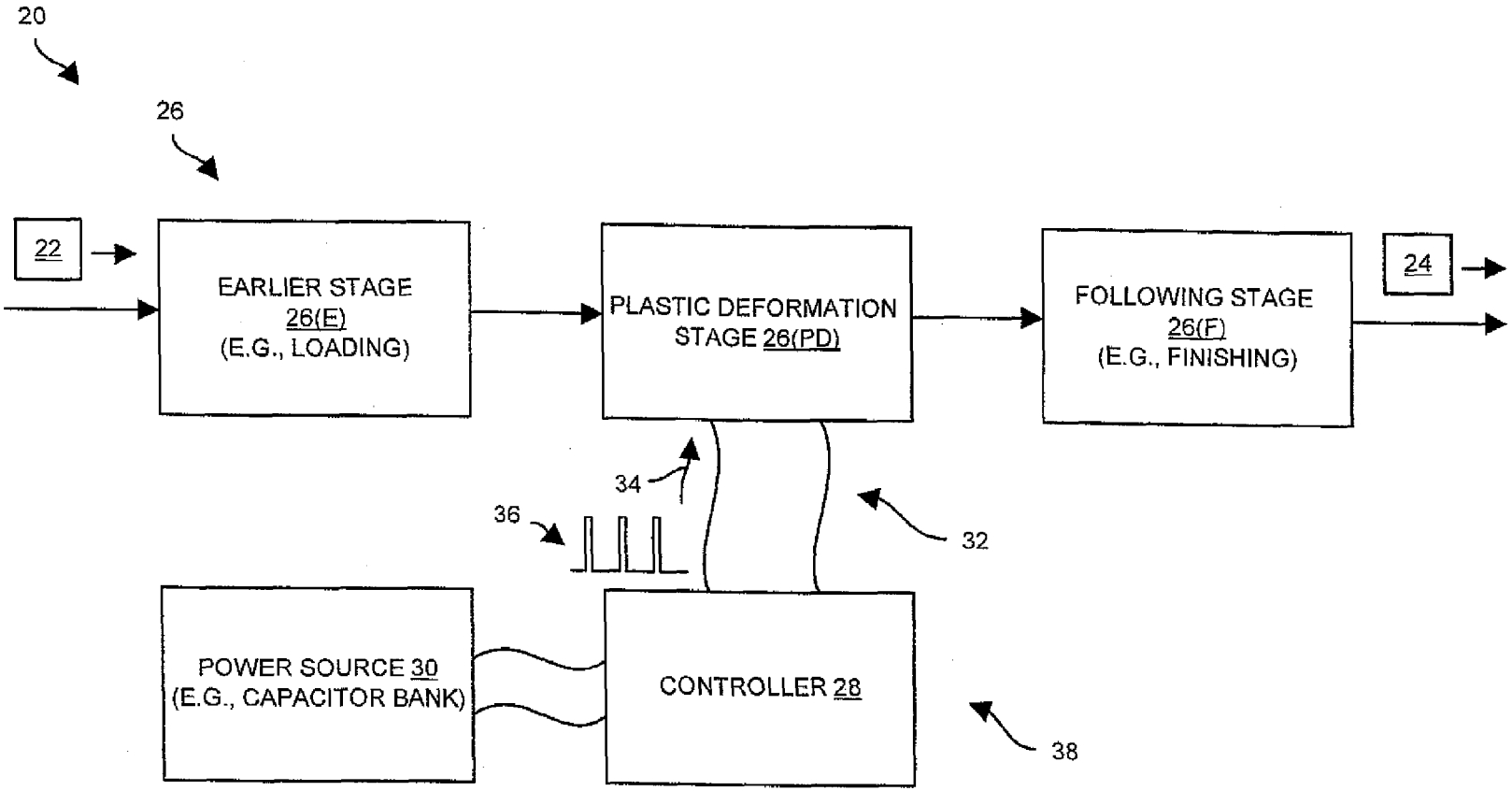
FIG. 1 is a block diagram of a system for manufacturing a product using electric current during a manufacturing stage that provides plastic deformation to material forming the product.

FIG. 1 shows an improved manufacturing system 20 which is configured to take material 22 (e.g., metal) and manufacture a product 24 from the material 22. The system 20 includes a plastic deformation stage 26(PD), a controller 28, a power source 30 and connections 32. The connections 32 (e.g., cabling) connects the controller 28 to the plastic deformation stage 26(PD) and to the power source 30.

The manufacturing system 20 further includes additional stages 26(E), 26(F) which are adjacent the plastic deformation stage 26(PD). In particular, the plastic deformation stage 26 is interconnected between an earlier stage 26(E) and a following stage 26(F) in a pipelined manner. In one arrangement, the earlier stage 26(E) is configured to receive the material 22 (e.g., a loading or mixing stage for metal matrix composite material, a loading stage for receiving sheet metal stock, an earlier plastic deformation stage, etc.) for subsequent processing by the plastic deformation stage 26(PD). Similarly, in one arrangement, the following stage 26(F) is configured to provide further processing (e.g., further plastic deformation with use of electric current, cleaning, coating, finishing, testing, etc.) after the plastic deformation stage 26(PD). It should be understood that three stages 26(E), 26(PD), 26(F) (collectively, stages 26) are shown by way of example only, and that other numbers of stages 26 are suitable for use by the system 20 as well.

During operation of the system 20, the controller 28 is configured to obtain power from the power source 30, and apply electric current 34 to the material 22 to reduce flow stresses within the material 22 while the plastic deformation stage 26(PD) provides the plastic deformation to the material 22. The electric current 34 is in the form of a series of high-density, short electric pulses 36. Accordingly, the combination of the controller 28 and the power source 30 is herein referred to as an electric pulse generator 38.

The series of high-density, short electric pulses 36 increases plasticity of the material 22 due to increasing the mobility of dislocations within the material 22. In some arrangements, the controller 28 is configured to provide an electric current density through the material 22 of at least 1000 Amperes per square millimeter with each electric pulse lasting no longer than 0.01 seconds (e.g., a few thousandths of a second). To provide electric current with such characteristics, the power source 30 is preferably equipped with a bank of capacitors that routinely charges from an external power supply (e.g., a main power feed) and discharges through the material 22 during plastic deformation within the plastic deformation stage 26(PD).

It should be understood that the series of high-density, short electric pulses 36 causes an electroplastic effect (EPE) for reduced flow stresses within the material 22 during plastic deformation. Since flow stresses within the material 22 are reduced, the material 22 enjoys enhanced ductility during plastic deformation thus making it easier for the manufacturer to plastically deform the material 22 without causing undesired effects (e.g., undesired work hardening). Additionally, the material 22 is essentially softer and less abrasive thus extending tool life for certain types of plastic deformation equipment (e.g., dies for compressing metal matrix composite material).

It should be further understood that the plastic deformation stage 26(PD) is capable of taking a variety of configurations depending on the type of material 22 and the type of plastic deformation being imposed on the material 22. These various configurations will now be discussed in further detail with reference to FIGS. 2 through 5.

Figure 2:
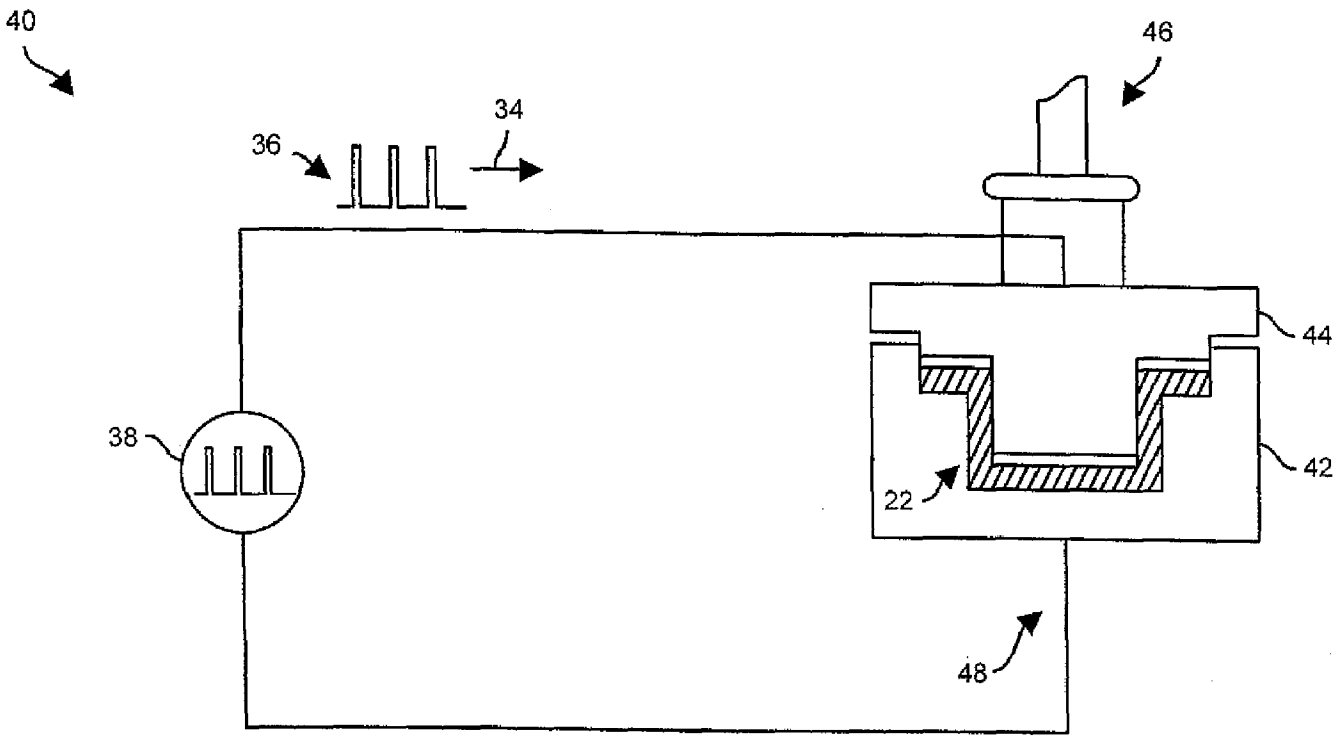
FIG. 2 is a detailed diagram of a pressing stage which is suitable for the plastic deformation stage of FIG. 1.

FIG. 2 is a detailed diagram of a pressing stage 40 which is suitable for use as the plastic deformation stage 26(PD) of the manufacturing system 20. The pressing stage 40 includes a lower die 42, a upper die 44 and pressing equipment 46 (e.g., a compression device shown generally by the arrow 46) for moving the upper die 44 relative to the lower die 42. The electric pulse generator 38 (i.e., the combination of the controller 28 and the power source 30, also see FIG. 1) couples through electrical connections 48 (e.g., cabling) to the lower die 42 and the upper die 44. Accordingly, the lower die 42 and the upper die 44 simultaneously serve as (i) molds for compacting and structurally shaping the material 22 into at least a portion of the product 24 (i.e., to define at least part of the product shape), as well as (ii) electrodes for applying the electric current 34 through the material 22.

During operation, the material 22 enters the lower die 42. The compression equipment 46 then moves the upper die 44 toward the lower die 42 and into contact with the material 22. The compression equipment 46 then continues to move the upper die 44 toward the lower die 42 to compress the material 22 and provide shape to the material 22 while the controller 28 (FIG. 1) concurrently directs the electric current 34 through the electrical connections 48, the lower and upper dies 42, 44 and the material 22. Accordingly, the material 22 plastically deforms to at least partially create the product 24. During plastic deformation, the series of high-density, short electric pulses 36 reduces flow stress within the material 22 thus enabling the material 22 conform to the shapes of the lower and upper dies 42, 44 in an enhanced manner. Moreover, such improved conformance provides less wear and tear on the dies 42, 44 thus extending their lifetimes.

It should be understood that variety of materials 22 are suitable for use by the pressing stage 40. For example, the material 22 is capable of being sheet metal (e.g., steel, copper, aluminum, etc.) which is stamped by the dies 42, 44. As another example, the material 22 is capable of being a metal matrix composite (MMC) (e.g., aluminum ceramic particle reinforced MMC materials) which is compacted by the dies 42, 44 prior to subsequent steps by other stages 26 (e.g., sintering). Other configurations for the material 22 are suitable for use as well.

It should be further understood that ceramic reinforcements are particularly abrasive to dies, e.g., when creating heatsink, frames, cases for electronic devices, and other parts. In particular, the low ductility of AL MMC, the poor combination of the soft aluminum matrix and the high abrasive properties of the ceramic reinforcement particles may decrease tool life vis-a-vis other types of material (e.g., dies can wear out 10 times more quickly with AL MMC compared to PM without ceramic reinforcements). However, the system 20 when applying the series of high-density, short electric pulses 36, reduces flow stresses during plastic deformation thus significantly improving handling of such hard to deform materials. That is, in contrast to conventional annealing which requires a very large amount of energy, the system 20 provides the series of high-density, short electric pulses 36 for robust stress relaxation with very little energy usage (e.g., the process is capable of being performed at room temperature using a bank of charged capacitors).

Furthermore, it should be understood that the increase in material ductility caused by the application of the electric pulses 36 reduces the possibility of crack formation at higher deformation rates vis-à-vis conventional plastic deformation processes without the application of the electric pulses 36. For example, during stamping (see FIG. 2), higher deformation without cracking is achievable with the application of the electric pulses 36 for robust and reliable stamping results. Further details will now be provided with reference to FIG. 3.

Figure 3:
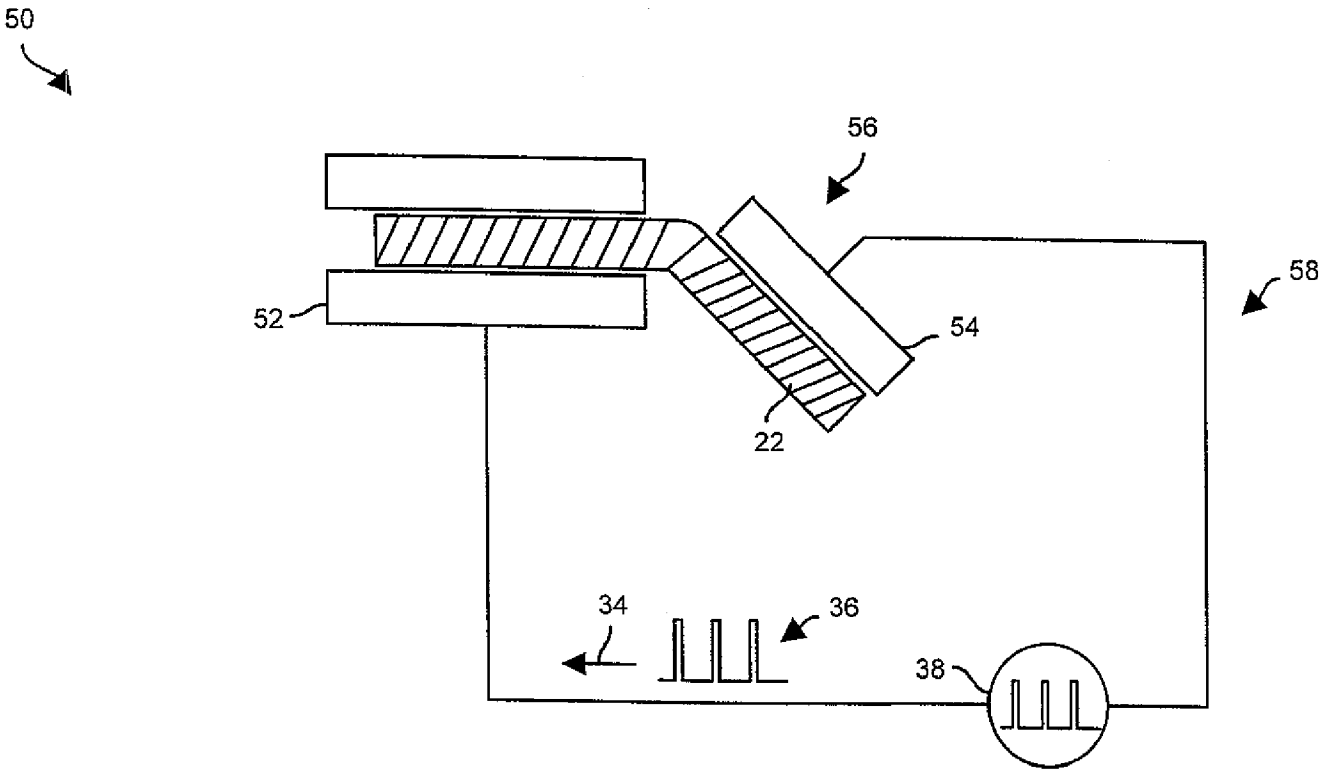
FIG. 3 is a detailed diagram of a bending stage which is suitable for the plastic deformation stage of FIG. 1.

FIG. 3 is a detailed diagram of a bending stage 50 which is suitable for use as the plastic deformation stage 26(PD) of the manufacturing system 20. The bending stage 50 includes a base 52, a bending device 54 and moving device 56 (e.g., bending equipment shown generally by the arrow 56) for moving the base 52 relative to the bending device 54. The electric pulse generator 38 (i.e., the combination of the controller 28 and the power source 30, also see FIG. 1) couples through electrical connections 58 (e.g., cabling) to the base 52 and the bending device 54. Accordingly, the base 52 and the bending device 54 simultaneously serve as (i) mechanical components for structurally shaping the material 22 into at least a portion of the product 24 (i.e., to define at least part of the product shape), as well as (ii) electrodes for applying the electric current 34 through the material 22.

During operation, the material 22 enters the base 52. The moving device 56 then moves the bending device 54 relative to the base 52 (e.g., by changing the angular orientation of the bending device 54 relative to the base 52) and into contact with the material 22. The moving device 56 then continues to move the bending device 54 relative to the bending device 54 to bend the material 22 while the controller 28 (FIG. 1) concurrently directs the electric current 34 through the electrical connections 58, the base 52, the bending device 54 and the material 22. As a result, the material 22 plastically deforms to at least partially create the product 24. During such plastic deformation, the series of high-density, short electric pulses 36 reduces flow stress within the material 22 thus enabling the material 22 conform to the bending forces provided by the base 52 and the bending device 54 in an enhanced manner. Moreover, such improved conformance provides less wear and tear on the base 52 and the bending device 54 thus requiring less energy and imposing less mechanical resistance on the components 52, 54, 56.

It should be understood that variety of materials 22 are suitable for use by the bending stage 50. For example, the material 22 is capable of being sheet metal (e.g., steel, copper, aluminum, etc.) which is folded by the bending stage 50. As another example, the material 22 is capable of being bar metal which is bent by the base 52 and the bending device 54. Other configurations for the material 22 are suitable for use as well. Further details will now be provided with reference to FIG. 4.

Figure 4:
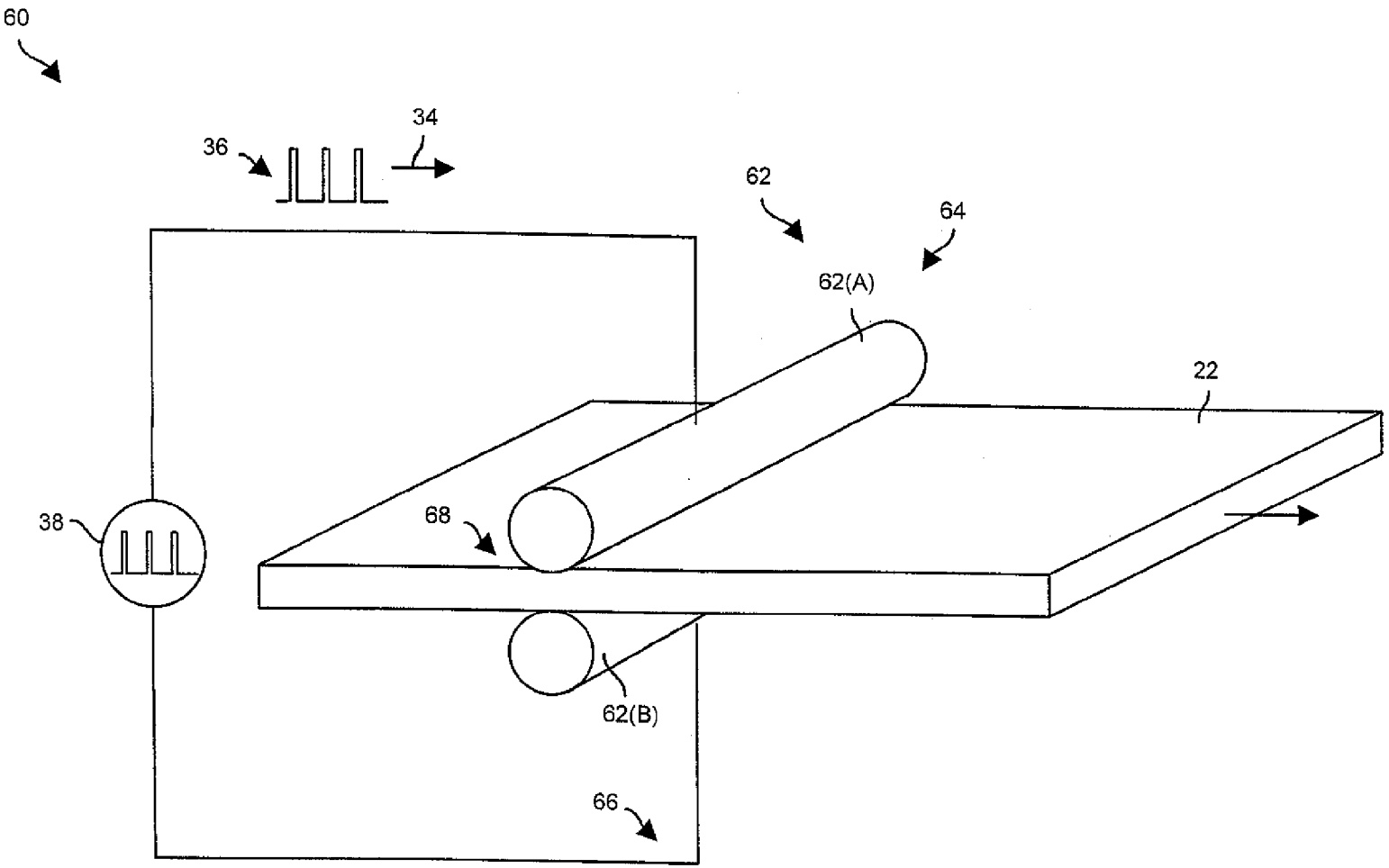
FIG. 4 is a detailed diagram of a roller assembly which is suitable for the plastic deformation stage of FIG. 1.

FIG. 4 is a detailed diagram of a rolling stage 60 which is suitable for use as the plastic deformation stage 26(PD) of the manufacturing system 20. The rolling stage 60 includes two rollers 62(A), 62(B) (collectively, rollers 62) and rolling equipment 64 (generally by the arrow 54) for turning the rollers 62. The electric pulse generator 38 (i.e., the combination of the controller 28 and the power source 30, also see FIG. 1) couples through respective electrical connections 66 (e.g., cabling) to the rollers 62. Accordingly, the rollers 62 simultaneously serve as (i) mechanical components for structurally shaping the material 22 into at least a portion of the product 24 (i.e., to define at least part of the product shape), as well as (ii) electrodes for applying the electric current 34 through the material 22.

During operation, the material 22 comes into electrical contact with the rollers 62 and enters a space 68 between the rollers 62. Accordingly, the rollers 62 roll the material 22 while the controller 28 (FIG. 1) concurrently directs the electric current 34 through the electrical connections 66, the rollers 62 and the material 22. As a result, the material 22 plastically deforms to at least partially create the product 24. During plastic deformation, the series of high-density, short electric pulses 36 provides stress relaxation within the material 22 thus enabling the material 22 more easily conform to compression from the rollers 62. Moreover, such improved conformance provides less wear and tear on the rollers 62 thus requiring less energy and imposing less mechanical resistance on the components 62, 64.

It should be understood that variety of materials 22 are suitable for use by the rolling stage 60. For example, the material 22 is capable of being sheet metal (e.g., steel, copper, aluminum, etc.) which is rolled by the rolling stage 60. As another example, the material 22 is capable of being thicker bar metal or thinner metal can material or foil which is tempered, compacted and/or stretched, etc. Other configurations for the material 22 are suitable for use as well. Further details will now be provided with reference to FIG. 5.

Figure 5:
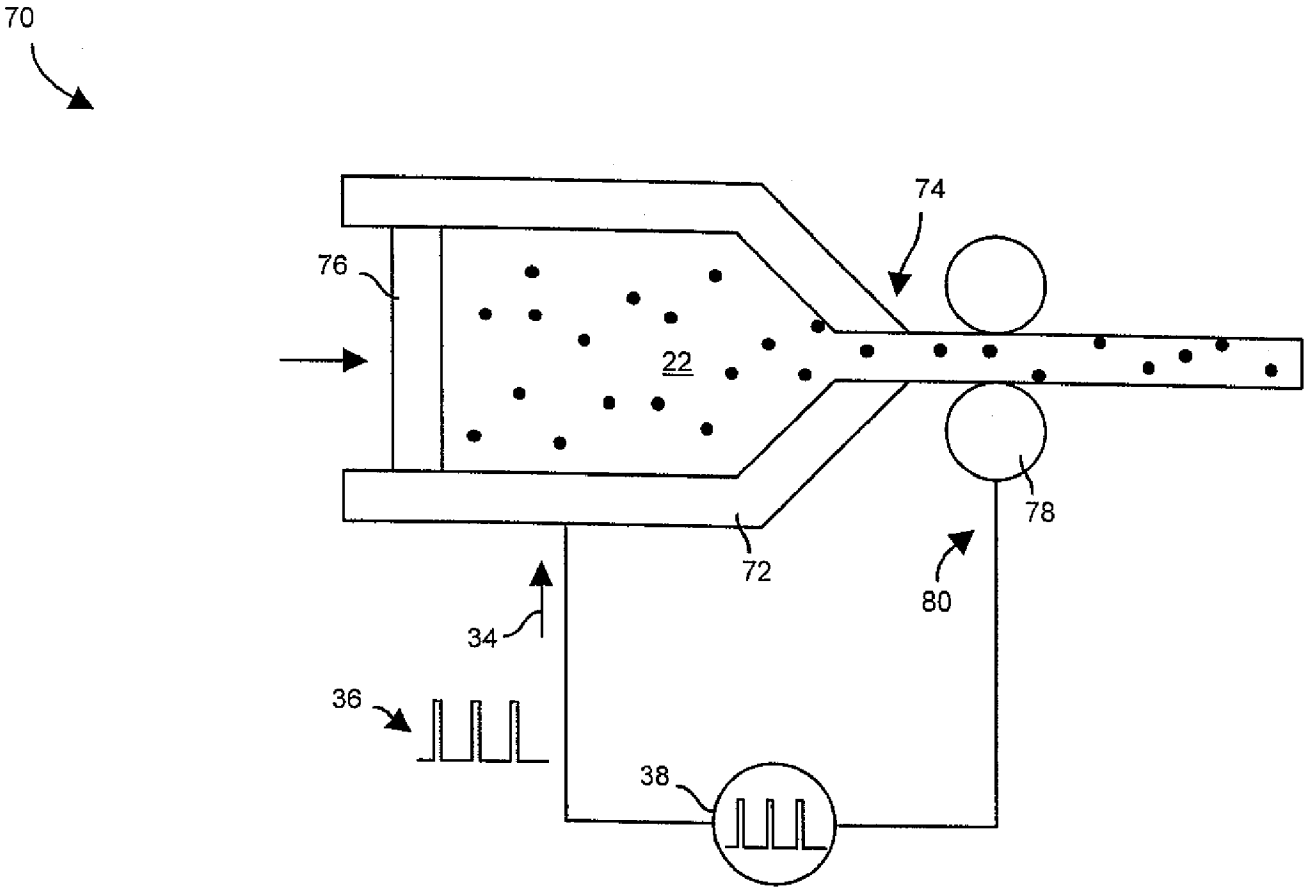
FIG. 5 is a detailed diagram of a drawing/extrusion stage which is suitable for the plastic deformation stage of FIG. 1.

FIG. 5 is a detailed diagram of an extruding stage 70 which is suitable for use as the plastic deformation stage 26(PD) of the manufacturing system 20. The extruding stage 70 includes a compression chamber 72, a die 74, a compression ram 76 for pushing the material 22 through the die 74, and additional components 78 (e.g., deflectors, rollers, etc.) downstream from the die 74. The electric pulse generator 38 (i.e., the combination of the controller 28 and the power source 30, also see FIG. 1) couples through electrical connections 80 (e.g., cabling) to the compression chamber 72 and the additional components 78. Accordingly, the compression chamber 72 and the additional components 78 simultaneously serve as (i) an apparatus for extruding the material 22 into at least a portion of the product 24, as well as (ii) electrodes for applying the electric current 34 through the material 22.

During operation, the material 22 enters the compression chamber 72. The compression equipment 76 then compresses the material 22 and forces the material 22 through the die 74. As the compression equipment 76 compresses the material 22, the controller 28 (FIG. 1) concurrently directs the electric current 34 through the electrical connections 80, the compression chamber 72, the additional components 78 and the material 22. Accordingly, the material 22 plastically deforms to at least partially create the product 24. During plastic deformation, the series of high-density, short electric pulses 36 reduces flow stress within the material 22 thus enabling the material 22 compress and pass through the die 74 in an enhanced manner. Moreover, such improved conformance provides less wear and tear on the die 74 thus extending equipment lifetimes.

It should be understood that variety of materials 22 are suitable for use by the extruding stage 70. For example, the material 22 is capable of being powder metallurgy (PM) material. As another example, the material 22 is capable of being extremely thin foil-like material (e.g., foil-like material with hard to deform properties such as tungsten, molybdenum, etc.). Other configurations for the material 22 are suitable for use as well.

It should be further understood that the plastic deformation stage 26(PD) is capable of being a drawing stage which is similar to the extruding stage 70. To operate as a drawing stage, the additional components 78 (e.g., rollers) pull the material 22 from the die 74. As the additional components 78 pull the material 22, the electric pulse generator 38 passes the electric current 34 (i.e., electric pulses 36) through the material 22 to reduce flow stresses in the material.

It should be further understood that, regardless of the whether the material 22 is drawn or extruded through the die 74, there are a variety of electrode configurations for precisely applying the electric current 38. One general configuration is shown in FIG. 5. However, other electrode placements are suitable as well such as using the die 74 as an electrode, using an auger bit as an electrode, and so on. These various electrode placements enable the manufacturer to precisely generated EPE for desired stress relaxation and key points during plastic deformation.

As mentioned earlier, the application of the series of high-density, short electric pulses 36 to the material 22 increases material ductility thus reducing the possibility of crack formation at higher deformation rates compared to conventional plastic deformation processes which do not use electric current to improve ductility. For example, in the context of stamping (FIG. 2), higher deformation without cracking is achievable with the application of the electric pulses 36. Similarly, in the context of bending (FIG. 3), larger deformation without cracking is achievable with the application of the electric pulses 36. In the context of rolling (FIG. 4), the increase in ductility by the application of the electric pulses 36 is capable of decreasing the straight cylindrical rolls bending by the roll force and produces more uniform thickness of the product 24, and larger thickness reduction is capable of being achieved without surface cracks. In the context of extrusion and drawing, the application of the electric pulses 36 enables achievement of a higher extrusion ratio (i.e., a ratio of the cross-sectional area of the billet to that of the extruded product 24) without surface defects. Further details will now be provided with reference to FIG. 6.

Figure 6:
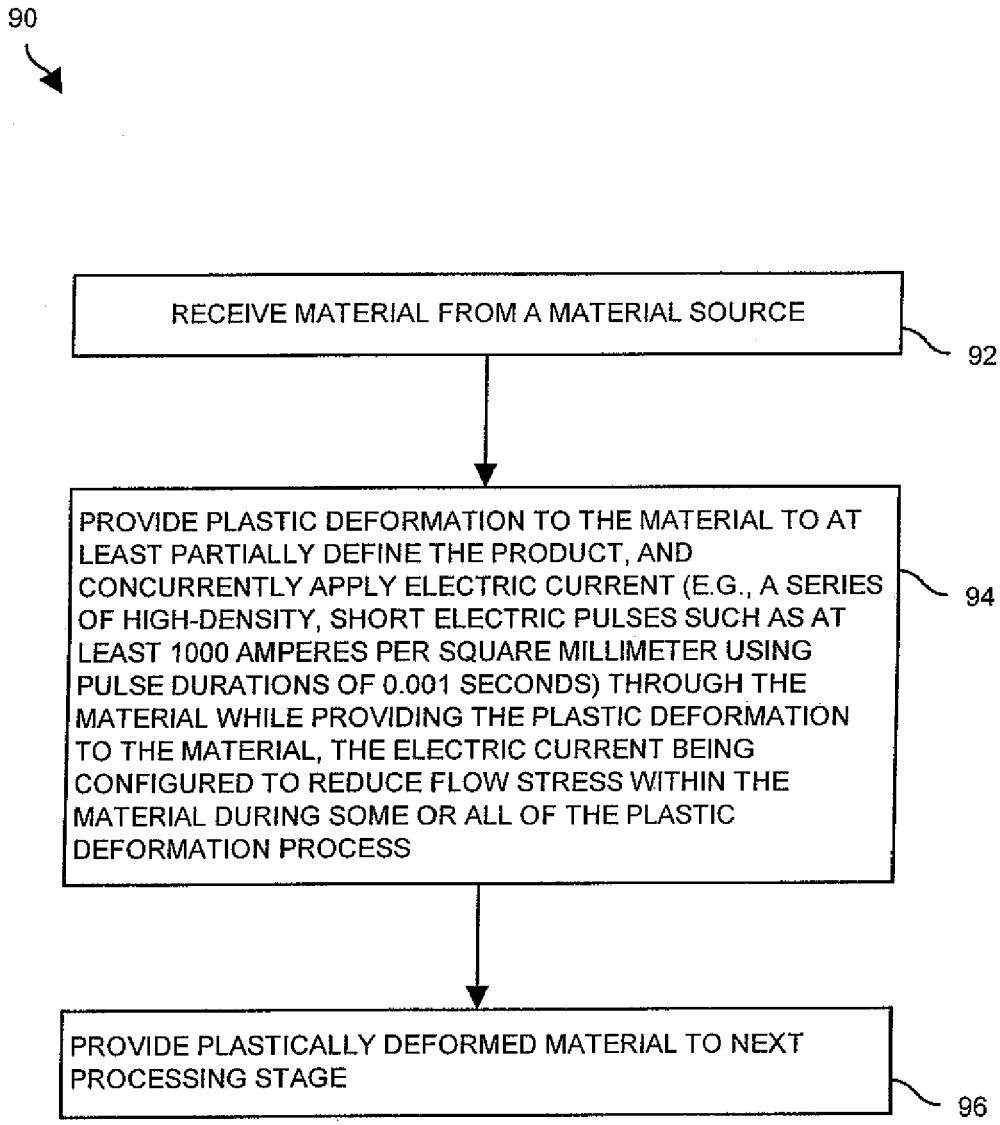
FIG. 6 is a flowchart of a procedure which is performed by the system of FIG. 1.

FIG. 6 is a flowchart of a procedure 90 which is performed by the system 20 when manufacturing the product 24 from the material 22. In step 92, the system 20 receives the material 22. For example, the stage 26(E) is a loading assembly which is configured to receive and temporarily hold the material 22.

In step 94, the system 20 provides plastic deformation to the material 22 to at least partially form the product 24. As mentioned above in connection with FIGS. 2 through 5, a variety of operations are capable of being performed by the plastic deformation stage 26(PD) to plastically deform the material 22 such as compacting, bending, rolling, extruding and drawing. Concurrently, the controller 28 applies the electric current 34 to the material 22. The electric current 34 (e.g., a series of high-density, short pulses 36) is configured to reduce flow stresses within the material 22 during plastic deformation.

In step 96, the plastically deformed material 22 moves to a subsequent processing stage 26. In some arrangements, the material 22 exiting the plastic deformation stage 26(PD) is the product 24 or close to becoming the completed product 24. In these arrangements, the next processing stage 26(F) is an outputting stage which performs a finishing operation (e.g., cleaning, coating, etc.). In other arrangements, the next processing stage 26(F) is another stage extensive process processing stage such as a stage which provides further plastic deformation using electric current 34, a stage that provides plastic deformation without electric current, etc.

As described above, improved techniques for manufacturing a product 24 involves the use of electric current 34 while plastically deforming material 22 (e.g., metal) during formation of the product 24. In particular, electric current 34 in the form of a series of high-density, short electric pulses 36 passes through the material 22 resulting in a reduction of flow stresses within the material 22 during plastic deformation (e.g., pressing, bending, rolling, drawing, extruding, combinations thereof, etc.). Such a reduction of flow stresses enhances material ductility during plastic deformation, and decreases wear and tear on the manufacturing equipment.

While this invention has been particularly shown and described with references to preferred embodiments thereof, it will be understood by those skilled in the art that various changes in form and details may be made therein without departing from the spirit and scope of the invention as defined by the appended claims.

What is claimed is:

1. A system for manufacturing a product, the system comprising:

a power source;

a plastic deformation stage configured to provide plastic deformation to material to at least partially form the product; and a controller coupled to the power source and to the plastic deformation stage, the controller being configured to apply electric current to the material to reduce flow stresses within the material while the plastic deformation stage provides the plastic deformation to the material;

wherein the controller, when applying the electric current to the material, is configured to:

pass a series of high-density, short electric pulses through the material as the plastic deformation stage provides plastic deformation to the material to increase dislocation mobility of the material during plastic deformation; and wherein the series of high-density, short electric pulses provides an electric current density through the material of at least 1000 Amperes per square millimeter, each electric pulse of the series of electric pulses having a duration which is less than or equal to 0.01 seconds.

2. The system of claim 1 wherein the power source includes a bank of capacitors; and wherein the controller, when passing the series of high-density, short electric pulses through the material, is configured to discharge the bank of capacitors through the material.

3. The system of claim 1 wherein the plastic deformation stage includes:

a first die and a second die which are configured to compress the material; and wherein the first die is configured to operate a first electrode and the second die is configured to operate as a second electrode to pass the series of high-density, short electric pulses through the material as the material is compressed between the first and second dies.

4. The system of claim 1 wherein the material is a metallic member; wherein the plastic deformation stage includes:

a base configured to hold a first portion of the metallic member, and a device which is configured to move relative to the base to bend a second portion of the metallic member relative to the first portion of the metallic member; and wherein the base is configured to operate a first electrode and the device is configured to operate as a second electrode to pass the series of high-density, short electric pulses through the metallic member as the first portion of the metallic member bends relative to the second portion of the metallic member.

5. The system of claim 1 wherein the plastic deformation stage includes:

a rolling assembly having a first roller and a second roller; and wherein the first roller and the second roller are configured to compact the material, and wherein the first roller is further configured to operate a first electrode and the second roller is configured further to operate as a second electrode to pass the series of high-density, short electric pulses through the material as the first and second rollers compact the material.

6. The system of claim 1 wherein the plastic deformation stage includes:

a drawing assembly having a die and a drawing device which is configured to draw the material between the first die and the second die; and wherein the die is configured to operate a first electrode and the drawing device is configured to operate as a second electrode to pass the series of high-density, short electric pulses through the material as the material is drawn between the die and the drawing device.

7. The system of claim 1 wherein the plastic deformation stage includes:

an extruding assembly having a compression portion which is configured to extrude the material through a die and an output portion; and wherein the compression portion is configured to operate a first electrode and the output portion is configured to operate as a second electrode to pass the series of high-density, short electric pulses through the material as the material is extruded through the die.

8. A method of manufacturing a product, the method comprising:

receiving material;

providing plastic deformation to the material to at least partially form the product; and applying electric current to the material while providing the plastic deformation to the material, the electric current being configured to reduce flow stresses within the material during plastic deformation;

wherein applying the electric current includes:

passing a series of electric pulses through the material as the material receives form from plastic deformation;

wherein passing the series of electric pulses includes:

providing an electric current density through the material of at least 1000 Amperes per square millimeter.

9. The method of claim 8 wherein providing the current density through the material includes:

giving each electric pulse of the series of electric pulses a duration which is less than or equal to 0.01 seconds.

10. The method of claim 9 wherein giving includes:

outputting the electric pulses from a charged bank of capacitors through the material.

11. The method of claim 10 wherein receiving the material includes:

obtaining, as the material, metal powder from a metal powder source, the metal powder being configured for powder metallurgy processing.

12. The method of claim 11 wherein obtaining the metal powder includes:

acquiring, as the metal powder, metal matrix composite material having Aluminum and a reinforcement.

13. The method of claim 8 wherein providing the plastic deformation to the material to at least partially form the product includes:

pressing the material between a first die and a second die; and wherein the first die is configured to operate a first electrode and the second die is configured to operate as a second electrode to pass high-density, short electric pulses through the material as the material is pressed between the first and second dies.

14. The method of claim 8 wherein the material is a metallic member; wherein providing the plastic deformation to the material to at least partially form the product includes:

holding a first portion of the metallic member in a base, and moving a device relative to the base to bend a second portion of the metallic member relative to the first portion of the metallic member; and wherein the base is configured to operate a first electrode and the device is configured to operate as a second electrode to pass high-density, short electric pulses through the metallic member as the first portion of the metallic member bends relative to the second portion of the metallic member.

15. The method of claim 8 wherein providing the plastic deformation to the material to at least partially form the product includes:

processing the material through a rolling assembly having a first roller and a second roller;

wherein the first roller and the second roller are configured to compact the material, and wherein the first roller is further configured to operate a first electrode and the second roller is configured further to operate as a second electrode to pass high-density, short electric pulses through the material as the first and second rollers compact the material.

16. The method of claim 8 wherein providing the plastic deformation to the material to at least partially form the product includes:

drawing the material between a die and a drawing device; and wherein the die is configured to operate a first electrode and the drawing device is configured to operate as a second electrode to pass high-density, short electric pulses through the material as the material is drawn between the die and the drawing device.

17. The method of claim 8 wherein providing the plastic deformation to the material to at least partially form the product includes:

extruding the material through a die of an extruder; and wherein a compression portion of the extruder is configured to operate a first electrode and an output portion of the extruder is configured to operate as a second electrode to pass high-density, short electric pulses through the material as the material is extruded through the die.

* * * * *

UNITED STATES PATENT AND TRADEMARK OFFICE

CERTIFICATE OF CORRECTION

PATENT NO. : 7,302,821 B1
APPLICATION NO. : 11/023103
DATED : December 4, 2007
INVENTOR(S) : Nader G. Dariavach and James A. Rice It is certified that error appears in the above-identified patent and that said Letters Patent is hereby corrected as shown below:

Cover Page, item (56) References Cited, Reference "2,973,043" should read -- 2,972,043 --.

Signed and Sealed this

Twenty-seventh Day of May, 2008

JON W. DUDAS
*Director of the United States Patent and Trademark Office*